US006481815B1

(12) United States Patent
Nariai

(10) Patent No.: US 6,481,815 B1
(45) Date of Patent: Nov. 19, 2002

(54) INK JET PRINTER AND ITS PRELIMINARY DRIVING METHOD

(75) Inventor: Kyoichi Nariai, Tokyo (JP)

(73) Assignee: Fuji Xerox Co., Ltd. (JP)

( * ) Notice: Subject to any disclaimer, the term of this patent is extended or adjusted under 35 U.S.C. 154(b) by 58 days.

(21) Appl. No.: 09/692,643

(22) Filed: Oct. 19, 2000

(30) Foreign Application Priority Data

Oct. 20, 1999 (JP) ..... 11-298446

(51) Int. Cl.[7] ..... B41J 29/38
(52) U.S. Cl. ..... 347/10; 347/9; 347/11
(58) Field of Search ..... 347/37

(56) References Cited

U.S. PATENT DOCUMENTS

| | | | | |
|---|---|---|---|---|
| 5,107,276 A | | 4/1992 | Kneezel | 347/60 |
| 6,386,664 B1 | * | 5/2002 | Hosono et al. | 347/9 |

FOREIGN PATENT DOCUMENTS

| | | | |
|---|---|---|---|
| EP | 0782924 | 7/1997 | B41J/2/045 |
| EP | 0788882 | 8/1997 | B41J/2/04 |
| EP | 0900657 | 3/1999 | B41J/2/045 |
| EP | 1024000 | 8/2000 | B41J/2/045 |
| EP | 1034934 | 9/2000 | B41J/2/16 |
| JP | 64-38246 | 2/1989 | B41J/3/04 |
| JP | 3-190747 | 8/1991 | B41J/3/04 |
| JP | 8-052885 | 2/1996 | B41J/2/175 |
| JP | 8-197744 | 8/1996 | B41J/3/04 |
| JP | 9-164694 | 6/1997 | B41J/2/175 |
| JP | 9-226116 | 9/1997 | B41J/2/045 |
| JP | 10-250064 | 9/1998 | B41J/3/04 |
| JP | 10-309810 | 11/1998 | B41J/2/175 |
| JP | 11-58779 | 3/1999 | B41J/3/04 |

* cited by examiner

*Primary Examiner*—John Barlow
*Assistant Examiner*—Alfred E Dudding
(74) *Attorney, Agent, or Firm*—Dickstein, Shapiro, Morin & Oshinsky, LLP.

(57) ABSTRACT

In the present invention, the preliminary waveform driving region lies in the period in which the head is accelerated just after the head starts moving for printing until it reaches the printing starting position, and a preliminary waveform generated in the preliminary waveform driving region sways the ink in the opening of the nozzle of the head to the extent that ink is not discharged to reduce the viscosity of the ink, and the printing is performed in the usual printing region immediately after the head passes the preliminary waveform driving region. Accordingly, the head may be driven for printing before the viscosity of the ink, which is reduced by the preliminary driving motion, is increased so that ink may be more easily discharged from the nozzle when the head performs the printing.

8 Claims, 8 Drawing Sheets

INK JET PRINTER AND ITS PRELIMINARY DRIVING METHOD

BACKGROUND OF THE INVENTION

The present invention relates to an ink jet printer and its preliminary driving method and, in particular, to an ink jet printer for driving a head in advance in the case where printing is performed by discharging ink from the nozzle of the head, and to its preliminary driving method.

In a conventional ink jet printer in which ink is discharged from the nozzle of a head to print a letter (or to form an image), the ink is always in contact with air at the opening of the nozzle and hence gradually becomes dry, which inevitably produces a phenomenon in which the viscosity of the ink becomes higher.

Since the higher viscosity of the ink increases the surface tension of the ink, the ink is hard to discharge if a force to discharge the ink is the same as before. As a result, this changes the direction of discharging of the ink or produces variations in the speed of the drop of the ink to reduce the quality of an image to be produced.

Accordingly, an ink jet printer in which, in the case where ink is not discharged for a predetermined time, ink is discharged to a region not to be printed and then new ink is prepared in the opening of a nozzle to discharge the ink to a region to be printed has been known as a first conventional technology (see Japanese Patent Laid-Open No. 9-164694).

As a second conventional technology has been known a method of reducing the viscosity of ink by applying a driving waveform onto a head to the extent in which the ink is not discharged to sway the ink in the opening of the nozzle (see Japanese Patent Laid-Open No. 64-38246). As a third conventional technology has been known an ink jet printer having a first memory device for memorizing a plurality of preliminary discharging data to preliminarily drive a head and a second memory device for memorizing a specific preliminary discharging pattern data selected from the plurality of preliminary discharging data (see Japanese Patent Laid-Open No. 8-52885).

The ink jet printer of the above-mentioned third conventional technology performs a preliminary driving motion of discharging the ink from all nozzles at the same time to recover clogging in nozzles in low temperature surroundings. In this ink jet printer, in the case where a plurality of nozzles are divided into groups of a predetermined number of nozzles and each of the divided groups of nozzles is filled with the ink of different color, in order to prevent the inks from being mixed with each other, a preliminary driving motion is performed such that each ink is discharged a different number of dischargings according to the color of the ink and that the discharging motions of the inks of the plurality of colors are finished at the same time, or a preliminary discharging data is selected according to the condition of the head.

The above-mentioned conventional ink jet printers present a problem that because the preliminary driving motion is performed before the printer starts printing, there is a short open time before the printer starts printing actually and the ink becomes dry during the short open time to produce a considerable effect on the quality of printing.

SUMMARY OF THE INVENTION

The present invention has been made in view of the above circumstances, and it is the object of the present invention to provide an ink jet printer capable of shortening the time between a preliminary driving motion and a printing motion to improve the quality of printing and its preliminary driving method.

An ink jet printer in accordance with the present invention is an ink jet printer for performing printing by discharging ink from a plurality of nozzles mounted on a head moving with a carrier. The ink jet printer comprises a position detecting device, a preliminary waveform generating device, and a printing driving waveform generating device. The position detecting device detects the present position of the head. The preliminary waveform generating device compares the output of the position detecting device with a preliminary waveform starting position which is previously set to detect that the head reaches the preliminary waveform starting position. Then, the preliminary waveform generating device generates a preliminary waveform during the preliminary waveform driving region previously set in the period in which the head moves from the position where it is detected that the head reaches the preliminary waveform starting position to a printing starting position. The printing driving waveform generating device compares the output of the position detecting device with the printing starting position previously set just after the preliminary waveform driving region to detect that the head reaches the printing starting position. Then, The printing driving waveform generating device generates a printing driving waveform during a printing region previously set after the time when it is detected that the head reaches the printing starting position. The preliminary waveform sways ink in the opening of the nozzle of the head to the extent that the ink is not discharged from the opening of the nozzle and wherein the printing driving waveform discharges the ink from the opening of the nozzle of the head.

In the present invention, the preliminary waveform driving region is made in the period of movement of the head just after the head starts moving for printing until it reaches the printing starting position, and the preliminary waveform generated in the preliminary waveform driving region sways the ink in the opening of the nozzle of the head to the extent where the ink is not discharged to reduce the viscosity of the ink and the printing is performed in the usual printing region immediately after the head passes the preliminary waveform driving region. Accordingly, this can drive the head for printing before the viscosity of the ink, which is reduced by the preliminary driving motion, is increased.

Also, a method of preliminarily driving an ink jet printer in accordance with the present invention is a method of preliminarily driving the head of an ink jet printer just before ink is discharged from a plurality of nozzles mounted on the head moving with a carrier to perform printing. The method of preliminarily driving an ink jet printer in accordance with the present invention comprises a first step of detecting that the head reaches a preliminary waveform starting position previously set after the head starts moving to perform printing. The method further comprises a second step of generating a preliminary waveform during a preliminary waveform driving region previously set, in the period in which the head moves from the position where it is detected that the head reaches the preliminary waveform starting position to a printing starting position. The method further comprises a third step of swaying the ink in the head by the preliminary waveform to the extent that the ink is not discharged from the opening of the nozzle of the head.

In the present invention, the preliminary waveform driving region is made in the period of movement of the head just after the head starts moving for printing until it reaches the printing starting position. The preliminary waveform generated in the preliminary waveform driving region sways the ink in the opening of the nozzle of the head to the extent where the ink is not discharged, whereby the viscosity of the ink can be reduced just before the usual printing is started. Also, the present invention is characterized in that a printing driving waveform is inputted to the head instead of the preliminary waveform when the head reaches the printing starting position after the head passes the preliminary waveform driving region and that the head starts printing base on the printing driving waveform.

BRIEF DESCRIPTION OF THE DRAWINGS

Preferred embodiments in accordance with the present invention will be described in detail with reference to the following figures, in which.

DESCRIPTION OF THE PREFERRED EMBODIMENTS

Figure 1:
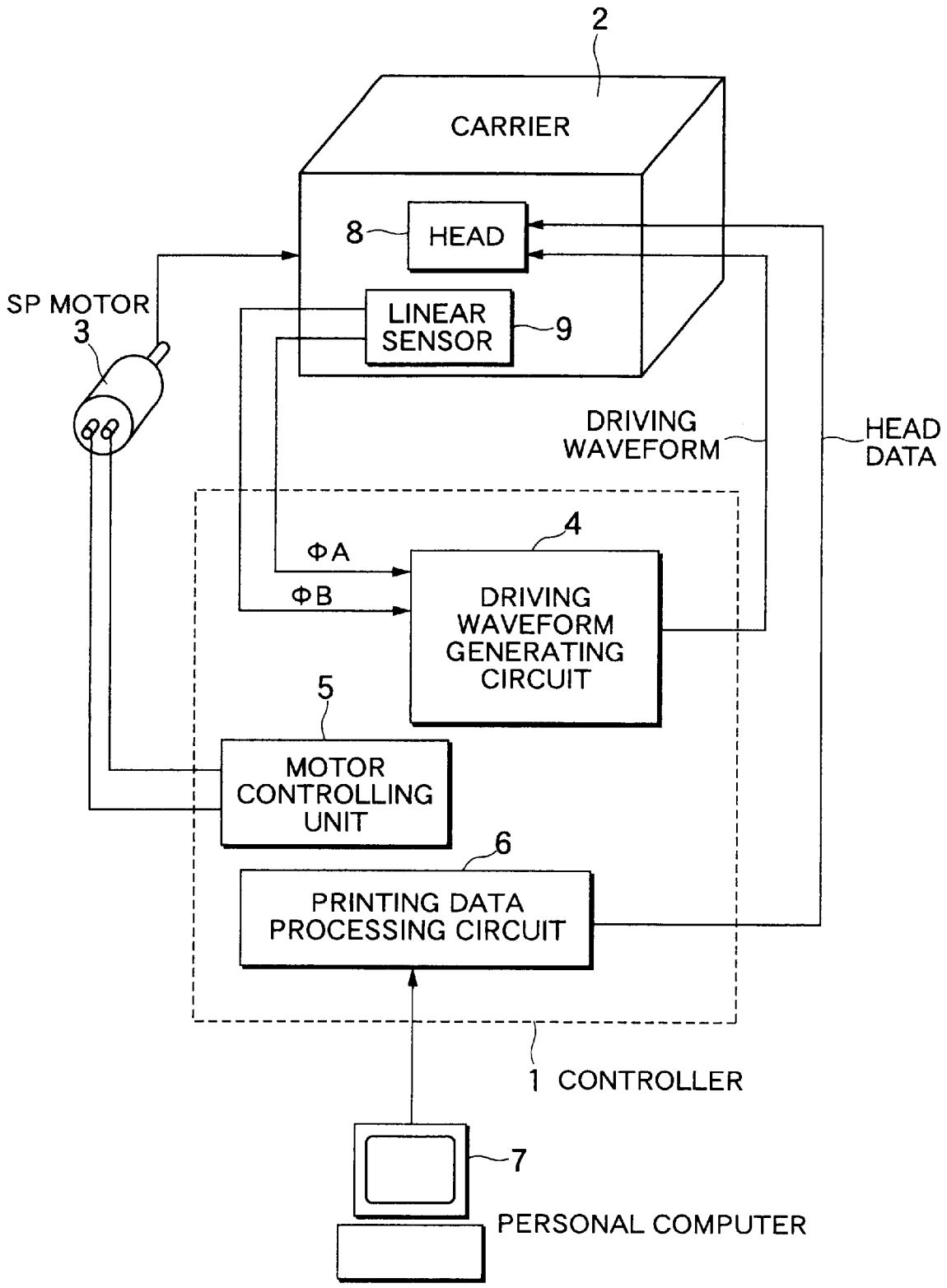
FIG. 1 is a block diagram showing one preferred embodiment of an ink jet printer in accordance with the present invention.

Next, the preferred embodiments in accordance with the present invention will be described with reference to the drawings. FIG. 1 is a block diagram showing one preferred embodiment of an ink jet printer in accordance with the present invention. As shown in FIG. 1, the ink jet printer in accordance with the present invention is generally constituted by a controller 1, a carrier 2, and a carrier moving mechanism including a spacing (SP) motor 3. The controller 1 is constituted by a driving waveform generating circuit 4, a motor controlling unit 5 for driving the SP motor 3, a printing data processing circuit 6 for processing a printing data from an external personal computer 7, a central processing unit (not shown), and the like.

The carrier 2 is mounted with a head 8 in which a plurality of nozzles are arranged in one line in the direction of the line, a linear sensor 9, and the like. Also, the carrier 2 can be moved in the predetermined direction by the SP motor 3. The carrier 2 is driven by a preliminary driving waveform from the driving waveform generating circuit 4 (hereinafter also referred to simply as a preliminary waveform), or by the input of a printing driving waveform to print a head data from a printing data processing circuit 6 when it performs printing.

Figure 2:
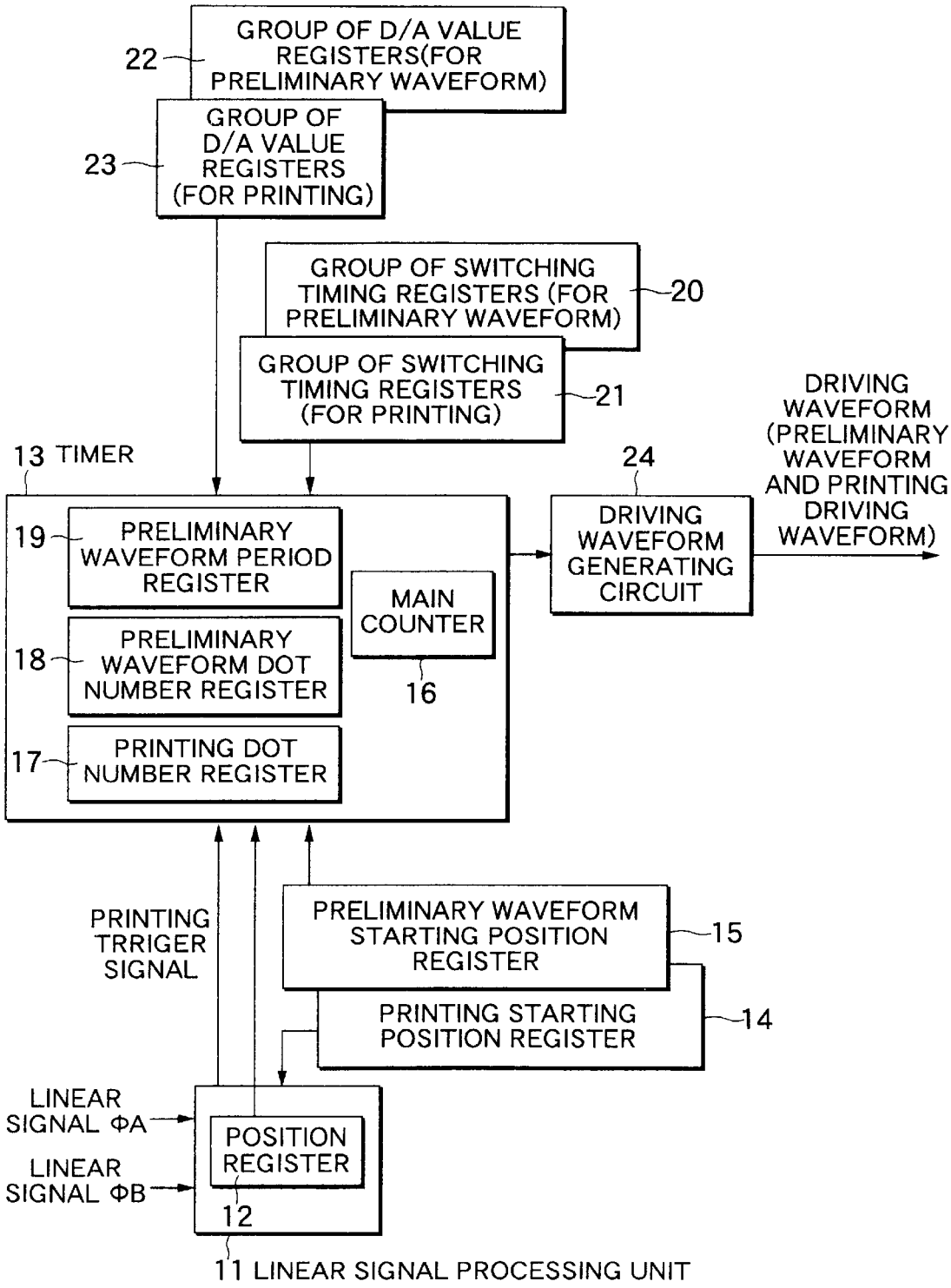
FIG. 2 is a block diagram showing the structure of a driving waveform generating circuit.

The driving waveform generating circuit 4 comprises, as shown in FIG. 2, a linear signal processing unit 11, a printing starting position register 14, a preliminary waveform starting position register 15, a timer 13 connected to them, a group of switching timing registers 20 for the preliminary waveform, a group of switching timing registers 21 for printing, a group of D/A value registers 22 for the preliminary waveform, a group of D/A value registers 23 for printing, and a driving waveform generating circuit 24. The linear signal processing unit 11 receives linear signals ΦA, ΦB from a linear sensor 9 described below and updates a position register 12 for designating the present position of the head 8. the printing starting position register 14 sets the output starting position of the printing driving waveform. The preliminary waveform starting position register 15 sets the output starting position of the preliminary waveform.

The timer 13 is constituted by a main counter 16 for counting up in synchronism with a system clock, a printing dot number register 17, a preliminary waveform dot number register 18, a preliminary waveform period register 19, and the like. The main counter 16 starts counting up when the value of the position register 12 is equal to the value of the preliminary waveform starting position register 15. The main counter 16 counts up in a period set in the preliminary waveform period register 19 and stops counting when the driving motion is completed by the number of dots set in the preliminary waveform dot number register 18.

While the main counter 16 is operating, the timer 13 controls the driving waveform generating circuit 24 according to the values set in the group of D/A value registers 22 for the preliminary waveform and the group of switching timing registers 20 for the preliminary waveform. That is, while the preliminary waveform is being outputted, the main counter 16 repeats counting in a period set in the preliminary waveform period register 19 and when the output of the main counter 16 is equal to the value of the group of switching timing registers 20 for the preliminary waveform, the group of D/A value registers 22 for the preliminary waveform are switched to change the driving waveform. While the printing is being performed, the main counter 16 is cleared by a printing trigger signal and while the printing is not performed, the main counter 16 operates similarly while the preliminary waveform is being outputted.

Figure 3:
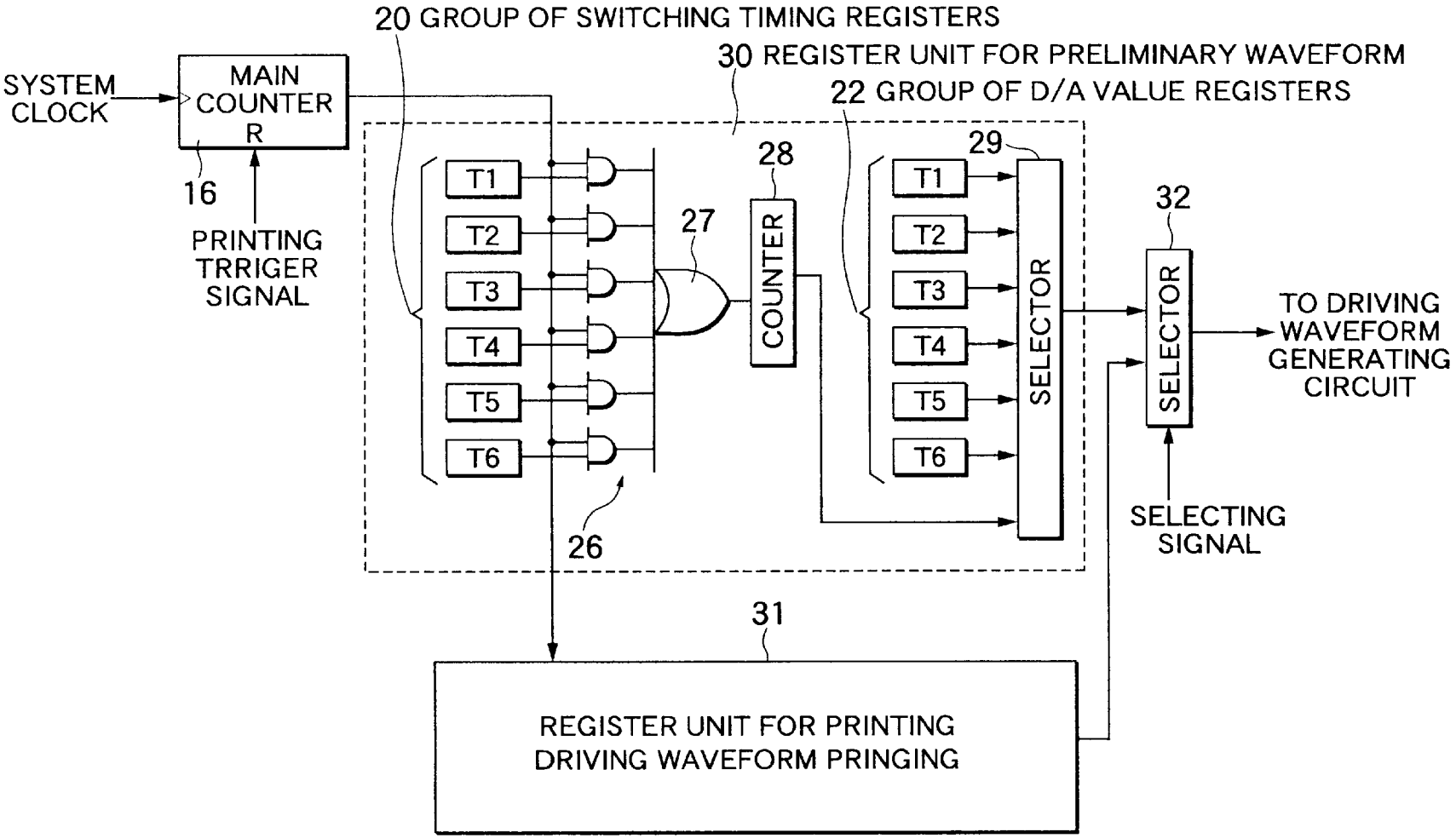
FIG. 3 is a circuit system diagram showing one preferred embodiment of a main part in FIG. 2.

FIG. 3 shows one preferred embodiment of a circuit system diagram of a main part in FIG. 2. In this connection, in FIG. 3, the like reference characters are attached to the like parts in FIG. 2 and the description for them will be omitted. In FIG. 3, the circuit of the main part comprises a preliminary waveform register unit 30 including the group of switching timing registers 20. The group of switching timing registers 20 has six switching timing registers each of which has each of values T1 to T6, a group of AND circuits 26 each of which is provided at the output side of each switching timing register 20, an input OR circuit 27, a counter 28, the group of D/A value registers 22 having six D/A value registers each of which has each of values D1 to D6, and a selector 29; a printing driving waveform register unit 31 having the same constitution as the preliminary waveform register unit 30; and a selector 32.

On the other hand, the linear sensor 9 shown in FIG. 1 has a well-known constitution and, for example, includes a linear scale 35 in which light-passing portions and light-not-passing portions are alternately arranged in a predetermined period, a light emitting part 36, and a light receiving part 37. In the linear sensor 9, the linear scale 35 is arranged such that is crosses the optical path starting from the light emitting part 36 to the light receiving part 37. The linear sensor 9 outputs a linear signal ΦA obtained by the light receiving part 37 and a linear signal ΦB whose phase is shifted 90 degrees with respect to the linear signal ΦA, respectively. The periods of the linear signals ΦA and ΦB are inversely proportional to the moving speed of the linear sensor 9.

Figure 4A:
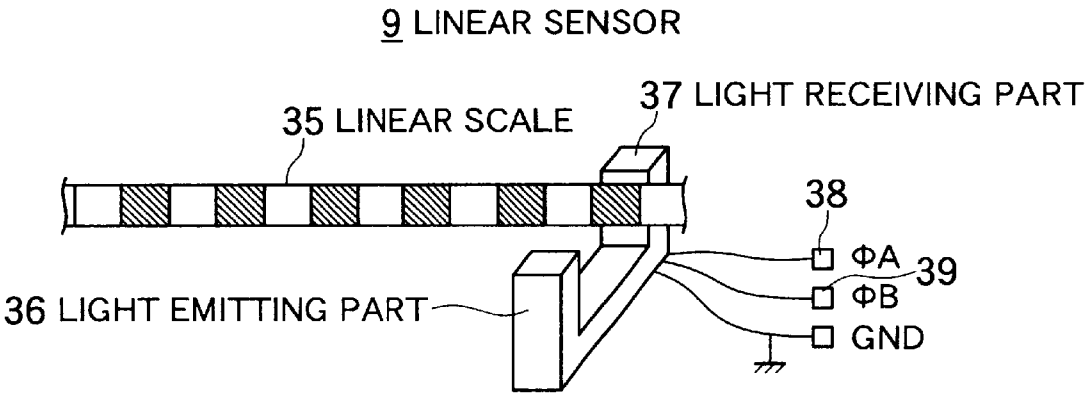
FIGS. 4A and 4B are illustrations illustrating the constitution and motion of a linear sensor in FIG. 1.
Figure 4B:
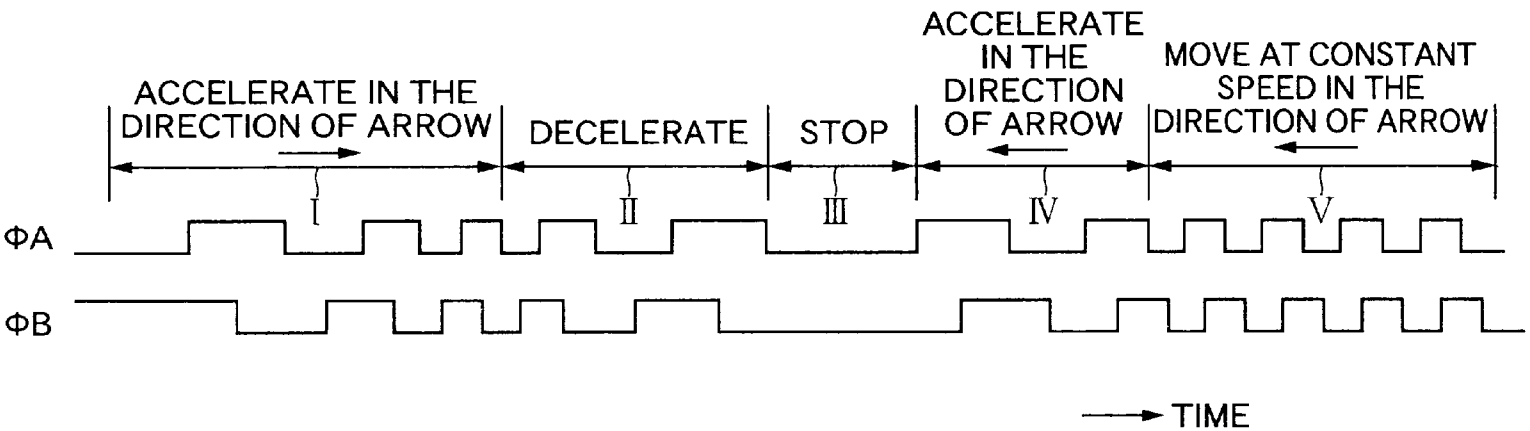

In this manner, the periods of the linear signals ΦA and ΦB of the linear scale 35 are gradually shortened in the range shown by I in FIG. 4B in which the linear scale 35 is accelerated in the right direction in FIG. 4A with respect to the light emitting part 36 and the light receiving part 37, and are gradually elongated in the range II in which the linear scale 35 is decelerated, and are not changed to be kept constant in the range III in which the linear scale 35 is stopped. In the range IV in which the linear scale 35 is accelerated in the left direction, the periods of the linear signals ΦA and ΦB of the linear scale 35 are gradually elongated and the linear signals ΦA and ΦB of the linear scale 35 are different in the phase IV from those in the range I. Also, when the linear scale 35 is moved at constant speed, the linear signals ΦA and ΦB are kept constant in period and in phase, as shown in the range V in FIG. 4B.

If the light emitting part 36 and the light receiving part 37 are moved with the carrier 2 with the linear scale 35 held fixed and the number of pulses of one of the linear signals ΦA and ΦB is counted, it is possible to specify the relative positions of the linear sensor 9 and the head 8 from the initial position. Also, it is possible to find the direction in which the linear sensor 9 is moved by detecting the phase relationship between the linear signal ΦA and the linear signal ΦB.

Next, the motion of one preferred embodiment shown in FIG. 1 and FIG. 2 will be described in detail with reference to FIG. 3, FIG. 5 to FIG. 7. The linear signal processing unit 11 in FIG. 2 receives the linear signals ΦA and ΦB outputted from the linear sensor 9 in FIG. 1. The linear signal processing unit 11 sets and updates the value of showing the absolute position of the head 8 in the position register 12 and generates a printing trigger signal when printing is performed. Then, the linear signal processing unit 11 supplies the printing trigger signal to the main counter 16 of the timer 13 as a reset signal.

In the above preferred embodiment, the preliminary waveform driving motion is performed just before a usual printing waveform driving motion is performed. That is, the driving waveform generating circuit 4 always compares the position data from the position register 12 showing the present position of the head 8 with the position data set in the preliminary waveform starting position register 15, based on the linear signal ΦA and ΦB. When both the position data agree with each other, the driving waveform generating circuit 4 judges that the head 8 is at the preliminary waveform starting position to make the system clock of the main counter 16 start counting up.

The main counter 16 circulates the counting values in a period set in the preliminary waveform period register 19. This motion is repeated by the number of the preliminary waveform dots set in the preliminary waveform dot number register 18. That is, a preliminary waveform driving region is determined by the number of preliminary waveform dots and the preliminary waveform period. The counter value of the main counter 16 is supplied to the group of AND circuits 26 in FIG. 3. Every time the counter value reaches any of the values T1 to T6 stored in the group of switching timing registers 20, the output of the OR circuit 27 is applied to the counter 28 through one corresponding AND circuit among the group of AND circuits 26 and the OR circuit 27, whereby the counting-up motion is performed.

Here, the above values T1 to T6 are set in the relationship of T1<T2<T3<T4<T5<T6. Also, if the maximum of the counter value in one period of the preliminary waveform is between T4 and T5, the counter 28 counts up every time the counter value of the main counter 16 reaches T1, T2, T3, and T4. The output of the counter 28 is supplied to the selector 29 in FIG. 3 to make the selector 29 select the D/A value inputted by the group of D/A value registers 22.

Figures 5A, 5B, 5C:
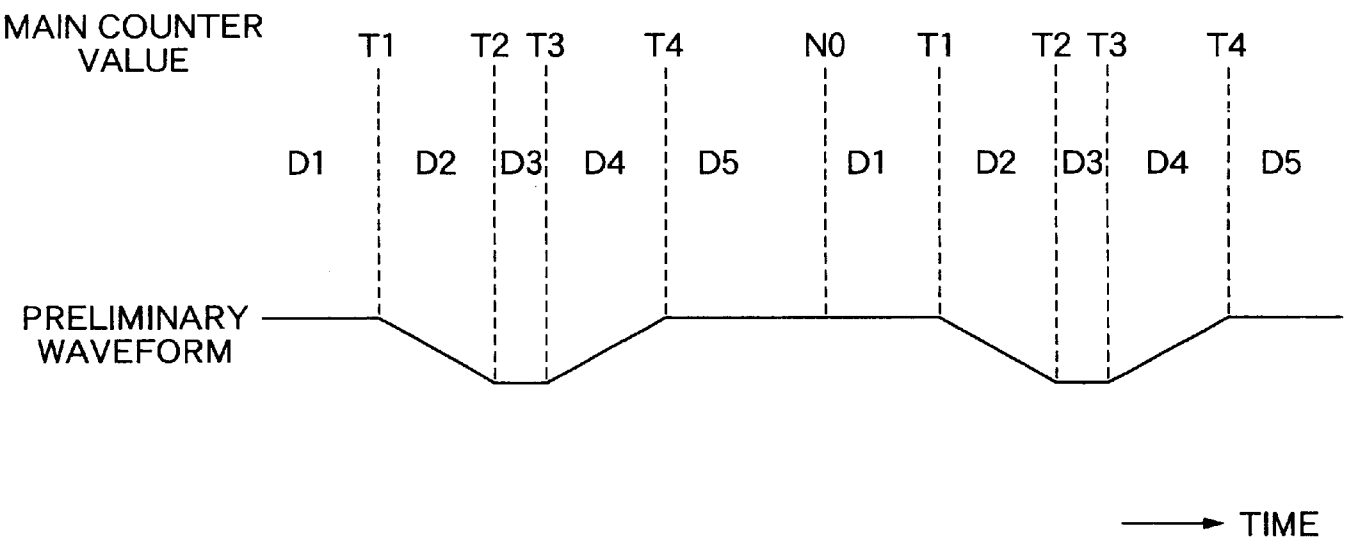
FIGS. 5A through 5G are time charts to illustrate the motion in FIG. 1 to FIG. 3.

The selector 29 selects the D/A value of D1 based on the output of the counter 28 until the counter value of the main counter 16 reaches T1. In the same way, the selector 29 selects D2 until the counter value of the main counter 16 reaches T2, D3 until the counter value of the main counter 16 reaches T3, D4 until the counter value of the main counter 16 reaches T4, and D5 until the counter value of the main counter 16 reaches the maximum value. Accordingly, if the counter values of the main counter 16 are those shown in FIG. 5A, the D/A values shown in FIG. 5B are outputted by the selector 29.

The D/A values are supplied to the driving waveform generating circuit 24 shown in FIG. 2 via the selector 29 shown in FIG. 3. The driving waveform generating circuit 24 is constituted in such a way that it outputs a waveform corresponding to the inputted D/A values. The driving waveform generating circuit 24 generates a preliminary waveform (shown in FIG. 5C and by a reference number 41 in FIG. 6) when the D/A values shown in FIG. 5B are inputted thereto. This preliminary waveform is supplied to the head 8 by the driving waveform generating circuit 4 shown in FIG. 1.

The preliminary waveform is set at the level in which the ink is swayed to the extent where the ink is not discharged from the opening of the nozzle of the head 8, which results in reducing the viscosity of the ink. That is, it is determined by the level of the driving waveform applied to the head 8 (that is, the preliminary waveform and the printing driving waveform) whether or not the ink is discharged from the opening of the nozzle of the head 8. This ink discharging mechanism is well known and its detailed description will be omitted.

Figure 7:
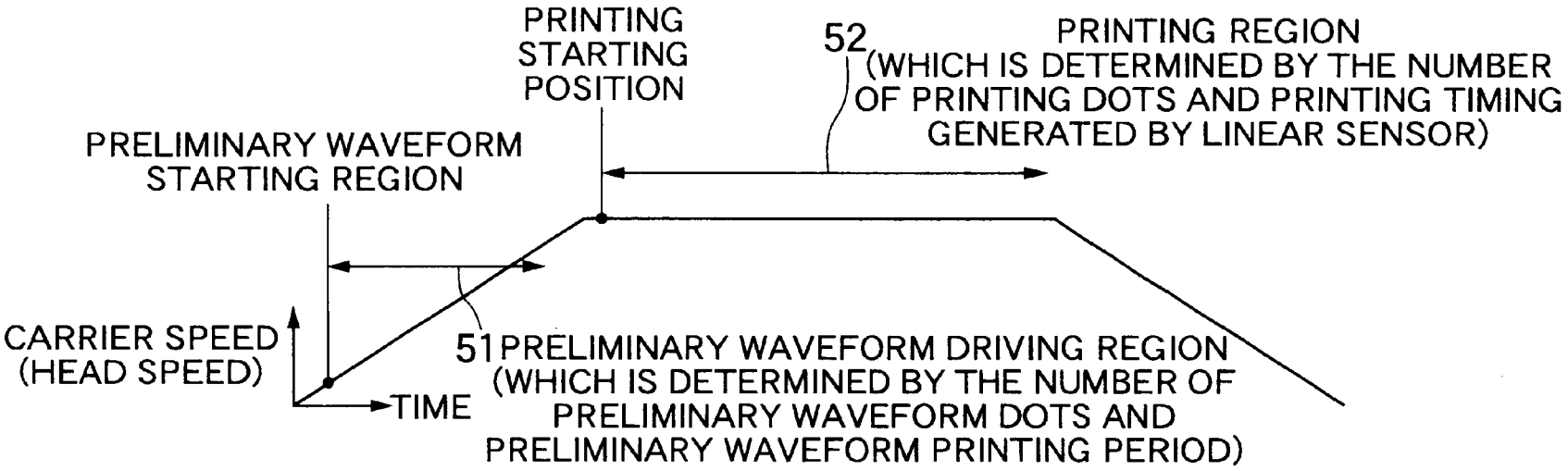
FIG. 7 is an illustration of the motion in FIG. 1 to FIG. 3.

In the present preferred embodiment, this preliminary waveform driving region is the range in the state where the head 8 is accelerated to the state of a constant speed after it reaches the printing starting position from the state of stop to perform the printing, as shown by the reference number 51 in FIG. 7. In this manner, the preliminary waveform period register 19 and the preliminary waveform dot number register 18 are set at suitable values such that the preliminary waveform driving region 51 finishes before the head 8 reaches the printing starting position. Just after the preliminary waveform driving region 51 finishes, the head 8 reaches the printing starting position, as shown in FIG. 7, the head 8 thereafter performs the usual printing in the printing region 52.

The linear signal processing unit 11 in the driving waveform generating circuit 4 always compares the position data from the position register 12 designating the present position of the head 8 with the position data set in the printing starting position register 14 in FIG. 2, based on the linear signals ΦA and ΦB. When both the position data agree with each other, the linear signal processing unit 11 judges that the head 8 reaches the printing starting position to generate a printing trigger signal shown in FIG. 5D. When the printing trigger signal is supplied to the timer 13, the system clock of the main counter 16 starts counting up. Further, when the selector signal is generated, the selector 32 shown in FIG. 3 is switched such that it selects the output of the printing driving waveform register unit 31.

The main counter 16 is reset every time the printing trigger signal is inputted. When the driving motion of the number of dots set in the printing dot number register 17 is finished, the circuit stops all the motions. The counter value of the main counter 16 when the usual printing is performed increases to take the values of T1 to T6 in sequence, as shown in FIG. 5E, until the printing trigger signal is inputted and is reset by the printing trigger signal.

Figures 5D, 5E, 5F, 5G:
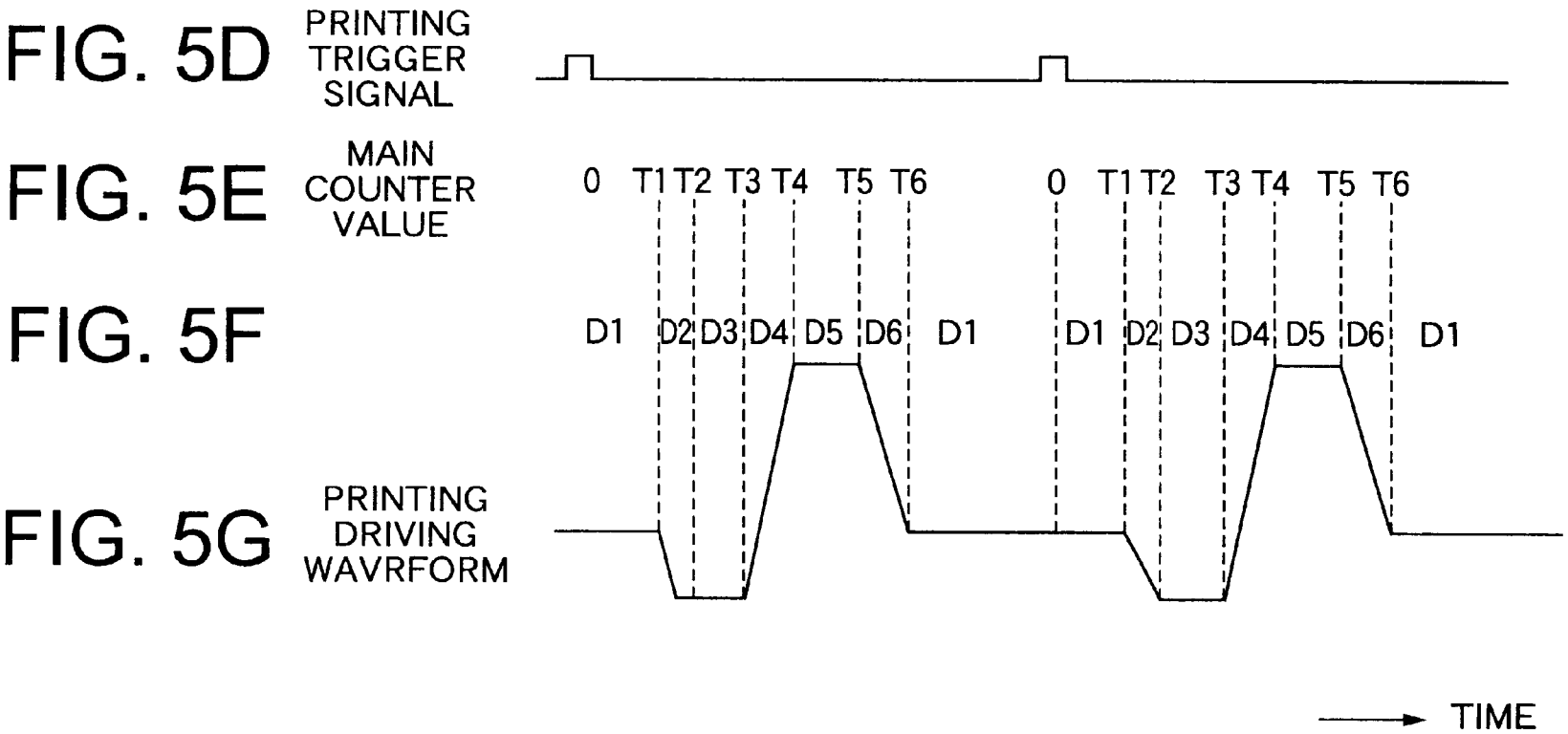
Figure 6:
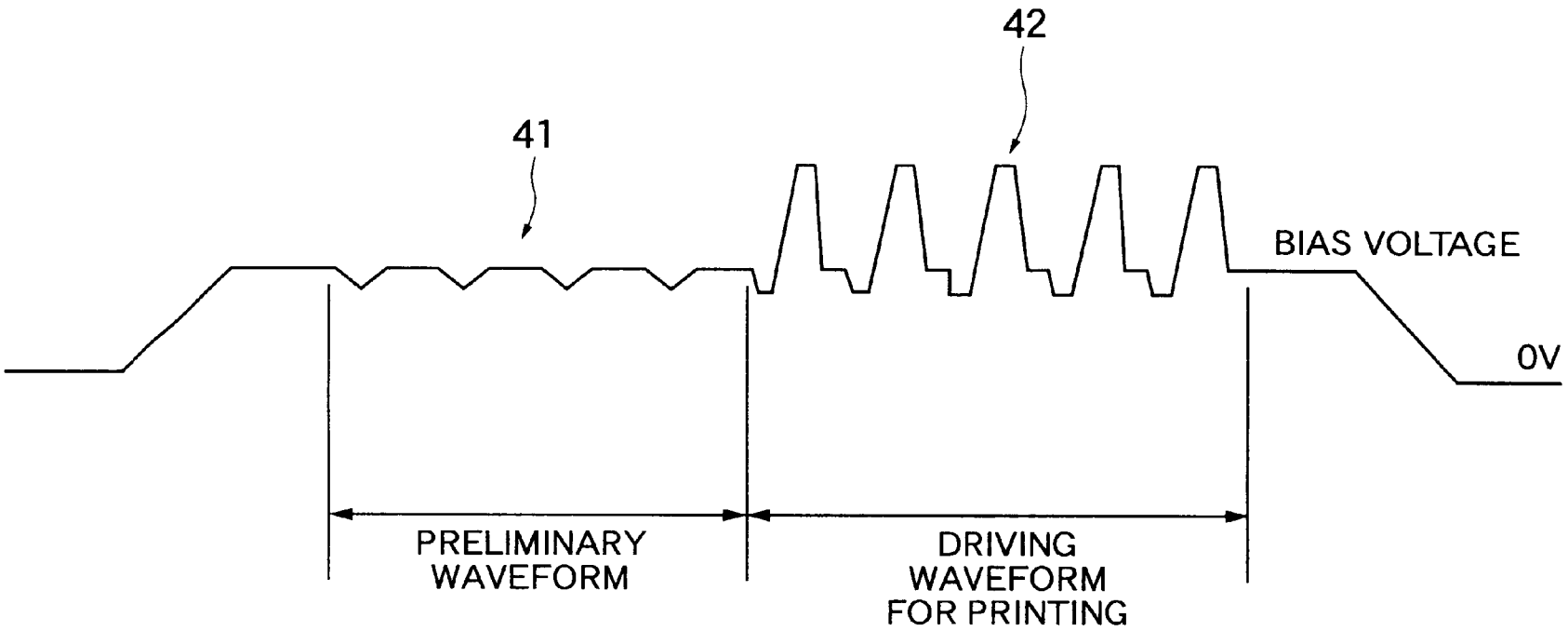
FIG. 6 is a signal waveform illustration showing a preliminary waveform and a printing driving waveform in FIG. 1 to FIG. 3.

In this way, the D/A values shown in FIG. 5F are taken out of the group of D/A registers 31 for printing in the printing driving waveform register unit 31 in FIG. 3 via the selector 32. The D/A values taken out of the group of D/A registers 23 for printing are supplied to the driving waveform generating circuit 24. The driving waveform generating circuit 24 generates a printing driving waveform corresponding to the inputted D/A values (shown in FIG. 5G and by a reference number 42 in FIG. 6). When the generated printing driving waveform is outputted to the head 8, the head 8 discharges ink from the nozzle to perform the usual printing.

As shown in FIG. 7, the head 8 reaches a predetermined speed just before it reaches the printing starting position and moves at constant speed in a printing region 52. The printing region 52 is determined by the number of printing dots in the printing dot number register 17 and the printing timing signal generated by the linear sensor 9.

In this way, in the present preferred embodiment, as is understood from FIG. 7, the preliminary waveform driving region 51 is made in the period in which the head 8 is accelerated just after the head 8 (carrier 2) starts moving for printing until it reaches the printing starting position, and the preliminary waveform generated in the preliminary waveform driving region 51 sways the ink in the opening of the nozzle of the head 8 to the extent where the ink is not discharged to reduce the viscosity of the ink and the printing is performed in the usual printing region 52 immediately after the head 8 passes the preliminary waveform driving region 51. Accordingly, this can drive the head 8 for printing before the viscosity of the ink, which is reduced by the preliminary driving motion, is increased and can easily discharge the ink from the nozzle when the head 8 performs the printing.

Also, in the present preferred embodiment, in the preliminary waveform driving region 51 is produced only the motion of swaying the ink in the opening of the nozzle of the head 8 to the extent where the ink is not discharged. Accordingly, it is not required to produce such a following complex motion as is required in the ink jet printer of the above-mentioned third conventional technology: that is, in the case where a plurality of nozzles are divided into groups of a predetermined number of nozzles and each of the divided groups or nozzles is filled with the ink of different color, in order to prevent the inks of different colors from being mixed, a preliminary driving motion is performed in which each ink is discharged in a different number of dischargings according to the color of the ink and the discharging motions or the inks of the plurality of colors are finished at the same time.

Therefore, it is possible to realize the preliminary driving motion by a simple constitution and to prevent the useless consumption of the ink when the preliminary driving motion is performed.

As described above, in the present invention, the preliminary waveform driving region is made in the period in which the head moves just after the head starts morning for printing until it reaches the printing starting position, and the preliminary waveform generated in the preliminary waveform driving region sways the ink in the opening of the nozzle of the head to the extent where the ink is not discharged to reduce the viscosity of the ink and the printing is performed in the usual printing region immediately after the head passes the preliminary waveform driving region. Accordingly, this can drive the head for printing before the viscosity of the ink, which is reduced by the preliminary driving motion, is increased and can easily discharge the ink from the nozzle when the head performs the printing. As a result, the drops of the ink discharged from all nozzles are made identical in speed and direction to improve the quality of the image (printing).

Also, the present invention only sways the ink in the opening of the nozzle of the head to the extent that the ink is not discharged in the preliminary waveform driving region. Accordingly, it is not required to produce such a following complex motion as is required in the ink jet printer of the above-mentioned third conventional technology: that is, in the case where a plurality of nozzles are divided into groups of a predetermined number of nozzles and each of the divided groups of nozzles is filled with the ink of different color, in order to prevent the inks of different colors from being mixed with each other, the preliminary driving motion is performed in which each ink is discharged a different number of dischargings according to the color of the ink and the discharging motions of the inks of the plurality of colors are finished at the same time. Therefore, it is possible to realize the preliminary driving motion by a simple constitution and to prevent the useless consumption of the ink when the preliminary driving motion is performed.

While the present invention has been described in connection with a preferred embodiment thereof, it will be understood that it is not intended to limit the invention to that embodiment. On the other hand, it is intended to cover alternatives, modifications, and equivalents as may be included within the spirit and scope of the invention as defined by the following appended claims.

What is claimed is:

1. An ink jet printer for performing printing by discharging ink from a plurality of nozzles mounted on a head moving with a carrier, the ink jet printer comprising:

a position detecting device that outputs data representing the present position of the head;

a preliminary waveform generating device that compares the output of the position detecting device with a preliminary waveform starting position to detect whether the head has reached the preliminary waveform starting position, and wherein the device further generates a preliminary waveform during a preliminary waveform driving region, wherein the preliminary waveform driving region lies within a period in which the head moves from the position where it is detected that the head reaches the preliminary waveform starting position to a printing starting position;

a printing driving waveform generating device that compares the output of the position detecting device with the printing starting position to detect whether the head has reached the printing starting position, and for generating a printing driving waveform after it is detected that the head has reached the printing starting position; and wherein the preliminary waveform sways ink in the opening of the nozzle of the head to the extent that the ink is not discharged from the opening of the nozzle of the head and wherein the printing driving waveform discharges the ink from the opening of the nozzle of the head.

2. An ink jet printer as claimed in claim 1, wherein the position detecting device comprises:

a linear sensor moving with the carrier; and a linear signal processing unit for processing the output linear signal of the linear signal.

3. An ink jet printer as claimed in claim 2, wherein:

the preliminary waveform generating device comprises:

a preliminary waveform starting position register that holds data representing the preliminary waveform starting position;

a group of D/A value registers for the preliminary waveform that holds D/A values for the preliminary waveform; and a timer that compares the output of the position detecting device with the output data of the preliminary waveform starting position register and outputs the D/A value for the preliminary waveform if the output of the position detecting device agrees with the output data of the preliminary waveform starting position register;

the printing driving waveform generating device comprises:

a printing starting position register that holds the data representing the printing starting position;

a group of D/A value registers for printing that holds D/A values for printing; and a printing trigger signal generating device that: generates a printing trigger signal when the output of the position detecting device agrees with the output of the printing starting position register; supplies the printing trigger signal to the timer; and outputs the D/A value for printing during the printing region; and wherein a driving waveform generating circuit which generates the preliminary waveform of the printing driving waveform is shared between the preliminary waveform generating device and the printing driving waveform device.

4. An ink jet printer as claimed in claim 3, wherein:

the driving waveform generating circuit:

compares the position data from the linear signal processing unit with the position data set in the preliminary waveform starting position register;

determines that the head has reached the preliminary waveform starting position when the position data outputted by the linear signal processing unit agrees with the position data set in the preliminary waveform starting position register; and causes the system clock of a main counter in the timer to start counting up;

the main counter circulates a count value based on a number of preliminary waveform dots, in a period set by the timer, and wherein the main counter counts up each time the count value of the main counter reaches a predetermined value.

5. An ink jet printer as claimed in claim 4, wherein:

the driving waveform generating circuit outputs a preliminary waveform corresponding to the D/A values for the preliminary waveform, the preliminary waveform being supplied to the head.

6. An ink jet printer as claimed in claim 5, wherein:

the preliminary waveform is set at a level such that when the ink is swayed, the ink is not discharged from the opening of the nozzle of the head.

7. A method of preliminarily driving an ink jet printer before printing, wherein printing is performed by discharging ink from a plurality of nozzles mounted on a head moving with a carrier, the method comprising the steps of:

detecting whether the head has reached a preliminary waveform starting position;

generating a preliminary waveform during a preliminary waveform driving region, wherein the preliminary waveform driving region lies within a period during which the head moves from a position where it is detected that the head has reached the preliminary waveform starting position to a printing starting position; and applying the preliminary waveform to sway ink in the head that the ink is not discharged from the opening of the nozzle of the head.

8. A method of preliminarily driving an ink jet printer as claimed in claim 7, the method including the step of:

applying a printing driving waveform to the head when the head reaches the printing starting position such that the head discharges ink from the opening of the nozzles based on the printing driving waveform.

* * * * *